United States Patent [19]

Morris et al.

[11] 3,957,241

[45] May 18, 1976

[54] BALL JOINT RELIEVABLE HANGER FOR TOWELS AND THE LIKE

[75] Inventors: Earl L. Morris, Whittier; Larry D. Fields, La Puente, both of Calif.

[73] Assignee: Acorn Engineering Company, Inc., Industry, Calif.

[22] Filed: Dec. 16, 1974

[21] Appl. No.: 533,002

[52] U.S. Cl. ..... 248/288; 248/309 R; 403/90; 403/129

[51] Int. Cl.[2] ..... F16B 45/00

[58] Field of Search ..... 248/481, 482, 483, 484, 248/181, 288, 291, 292, 293, 294, 309; 403/90, 103, 104, 106, 76, 93, 96, 129, 144, 328, 56, 114, 116; 74/527

[56] References Cited

UNITED STATES PATENTS

| | | | |
|---|---|---|---|
| 791,020 | 5/1905 | Forg | 248/276 |
| 1,333,432 | 3/1920 | Maier | 248/288 X |
| 2,202,697 | 5/1940 | La Hodny | 248/481 X |
| 2,901,207 | 8/1959 | Adam | 248/294 X |
| 3,355,565 | 11/1967 | Daul | 74/527 X |
| 3,409,317 | 11/1968 | Richards | 403/129 |
| 3,625,553 | 12/1971 | Mattioli | 248/484 |
| 3,847,336 | 11/1974 | Morris et al. | 248/294 |
| 3,900,180 | 8/1975 | McPhee | 248/288 A |

FOREIGN PATENTS OR APPLICATIONS

| | | | |
|---|---|---|---|
| 29,853 | 10/1911 | United Kingdom | 248/294 |
| 47,930 | 10/1933 | Denmark | 248/294 |
| 1,111,519 | 7/1961 | Germany | 74/527 |

*Primary Examiner*—Roy D. Frazier
*Assistant Examiner*—Lawrence J. Staab
*Attorney, Agent, or Firm*—Ben E. Lofstedt

[57] ABSTRACT

A relievable hanger for towels and the like is disclosed which incorporates a ball having a fixed rod extending therefrom. The ball is movably captured within a socket to form a ball joint. A portion of the ball is bored out to receive therein a spring-loaded element with a rounded, blunted end. Positioning the rod upwardly to serve as a hanger for towels and the like disposes the blunted-end of the spring-loaded element over a detent within the socket. The blunted end is urged by the spring into the detent which relievably locks the rod in its upright position.

5 Claims, 2 Drawing Figures

BALL JOINT RELIEVABLE HANGER FOR TOWELS AND THE LIKE

SUMMARY OF THE INVENTION

1. Field of the Invention:

This invention relates to improvements in self-relieving hangers for articles of clothing and the like.

2. Description of the Prior Art:

Hangers which are mountable to vertical supports such as walls for supporting the weight of articles of clothing and the like may be broadly classified as either fixed or relievable. While the fixed hangers find wide use and application in many commercial and residential installations, such are not as suitable in institutional facilities where the danger of suicide may be quite high. Persons so confined in penal and mental institutions and the like are prone to become so depressed as to attempt to terminate their lives by committing suicide. It frequently occurs that persons so confined attempt to commit suicide by hanging themselves by the use of any tensile object near at hand, as for example, a torn-up bed sheet or other similar object. The person then must seek out a suitable support structure to which such tension element may be attached, such as a clothes' hook. Such a wall-mounted fixed clothes hook is frequently capable of supporting hundreds of pounds of weight, such as the body of the person confined to the institution, and, therefore, poses a potential hazard for such would-be suicide victims.

Consequently, it is highly desirable to incorporate in the design of a clothes' hook intended for institutional use a means for permitting the hook to yield or release under an excess load. Once released, the relievable clothes' hook should allow the clothing articles and the like to fall clear of the hook or arm and as well as the hook's bracket so that none of the articles will remain hanging on the arm or bracket.

Such a device has been previously described in U.S. Patent No. 2,901,207. However, in this particular invention, the holding force is governed by the compression of fibrous frictional material. As a result, the holding force may be varied independently of the journal pin adjustment. Further, the functional characteristics may be varied by the prolonged compression of such material which tends to produce a permanent compression of such material thereby changing the value of the pre-set holding force. Additionally, the introduction of fluids, such as water, saliva, urine, and other similar fluids will generally initially reduce the frictional holding force. Thereafter, however, such fluids thereinto or thereon will oftentimes produce a swelling and expansion of the frictional material thereby increasing the holding force of the relievable hanger. This effect will, of course, be compounded should the material be heated with a match or the like.

Further, most fibrous frictional materials are combustible and would be partially or fully destroyed by the application of fire or excessive heat. Should this happen, the arm could not be set in its article-holding position.

In addition, such units which utilize a threaded journal pin for adjusting the holding force must be either riveted or peened on the end opposite to the adjusting head in oder to retain it in a fixed position so as to not disturb the pre-set holding force. Once accomplished, if readjustment is required, extensive modification to the unit is required, including removal from the vertical support to accomplish this modification.

And still further, the use of a teat to limit the upswing of the arm to maintain the arm in a position which is substantially perpendicular to the vertical support dictates that the installation of the relievable arm be only one way. If the unit should be installed upside down, the teat would then limit the down swing of the arm, thereby creating a non-relievable arm. This of course, could be used to commit suicide - exactly what the relievable hook was designed to prevent.

SUMMARY OF THE INVENTION AND OBJECTS

The present invention relates to improvements in relievable hangers for articles of clothing and the like. The hangers contemplated by this invention are those which are generally supported on the wall within a recess, and are designed to carry a predetermined load, such as presented by articles of clothing and the like, but will yield or relieve when a load in excess of this predetermined amount is placed on the hangers. In the event that such a hanger yields, the support hook or arm will turn downwardly towards a vertical position, thereby assuming a position in which the object producing the excessive loading is forced to slide off the arm. To ensure that such an object will slide off the arm, the hook or arm is of such design that once it has relieved and assumed its relieved position, it will not support any object.

It will be appreciated that such relievable hangers embodying the foregoing features are, and may be, usefully applied in many locations. Locations in which such hangers find wide usefulness and meet an important need are jail or prison cells, as well as other housing facilities created for the safe confinement of prisoners and other persons. As previously discussed, persons so confined in such institutions attempt to commit suicide by hanging themselves. Typically, under such distraught or abnormal mental aberations, such persons will attempt to make use of any tensile object at hand, such as a torn up sheet, towel, or pillowcase. Following the acquisition of such a tensile object, the person will seek out a suitable object to which the tensile object may be attached, such as a fixed, non-relievable clothes hook or the like. A non-relievable clothes hook is frequently suitable for securely supporting the entire weight of the human body.

In considering the invention in very broad terms, it can be said that my invention comprises a ball having a fixed rod forming an arm extending therefrom wherein the ball is movably captured within a socket to form a ball joint. A portion of the ball is bored out to receive therein a spring-brased element with a rounded, blunted end. A detent is provided on the inside of the socket which is adapted to receive the blunted end of the spring-biased element. When the rod fixed to the ball is positioned upwardly to serve as a hanger for towels and the like, the blunted-end of the spring-loaded element is urged into a detent thereupon relievably locking the rod in its upwardly projecting position. When a sufficiently heavy weight is impressed upon the upright rod serving as the hanger, the blunted end of the spring-biased element is forced against the spring and moves into the bored-out portion of the ball, thereby unlocking the rod from its upwardly projecting hanger position. When this occurs, the rod is relieved thereby allowing the arm to ball downwardly at an angle sufficient to permit the heavy tension element to slide off the arm and to defeat the attempt to commit suicide. In order to retain its functional utility as a clothes carrying hook the yieldable means formed by the spring-loaded element and the detent is designed to support both the hook in an outwardly projecting position and a load substantially smaller than that produced by the weight of a human, so that the device will perform its normally intended function and yet not allow the arm to support the weight of an intended suicide victim.

To accomplish this, the load at which the hook will release does not generally exceed thirty pounds. Generally, the weight of a person who might attempt to commit suicide is one hundred pounds or greater. Consequently, it is possible to separate the functional utility of a clothes supporting hook and that a wall-anchoring device capable of supporting much larger weights such as the human body, and to achieve this functional separation with reasonable assurance that the force yielding point of the hook would occur before the suicide becomes effective. To accomplish this, the restraining force normally sustaining the unloaded hook or clothing-loaded hook must be designed so that the force at which the arm relieves cannot be adjusted by the confined person so as to produce a towel hook which is capable of supporting the weight of a human for any appreciable length of time to allow a person to commit suicide.

It is a primary object of the present invention to provide a clothes hook which is mountable in a wall recess which will support the weight of such articles as clothing and the like but when he weight of a person, which generally exceeds 100 pounds, is impressed upon it, such a weight will be sufficient to cause the arm to relieve downwardly to cause the tension element, such as previously described, to slide from the arm, and thus, thwart an attempt to commit suicide.

Additionally, it is an object of the present invention to form such a releasable arm that the tensile element will not be further restrained or caught on the arm in its downwardly projecting position; such, of course, would defeat the purpose of the yielding or releasing feature.

An important feature of the present invention is to provide a convenient means of pre-setting the hook's holding force at the time of manufacture so that it cannot support the weight of a human.

A further important feature of the present invention is to provide a vandalproof relievable clothes hook.

Another important object of this invention is to provide a relievable hook which may be installed in either of the two vertical positions. Such devices found in the prior art similar to the invention, disclosed in U.S. Pat. No. 2,901,207, may be installed in only one of the two possible vertical positions. If installed upside down from its normal position, the hook will not operate as a relievable hook but instead operate as a non-relievable hook.

An even further object of the present invention is to provide a relievable hanger of such design and construction which may be readily and inexpensively produced from a sheet metal die cut and formed into a ball joint socket with such few additional low-cost elements which can be easily produced by conventional shop operations.

Another purpose and object of this invention is to provide a releaseable hanger which will comply with the multitudinous safety regulations and requirements of those authorities having charge of the design and construction of penal institutions, juvenile homes, hospitals for the insane, jails, reformatories, and such facilities as those for retarded and feeble-minded persons.

Other objects and uses of the invention will appear from a detailed description of the invention, which consists in the features of construction and combinations of parts hereinafter described and claimed. Such will be more clearly understood in view of the following description when taken in conjunction with the drawings wherein:

DESCRIPTION OF THE PREFERRED EMBODIMENT

STRUCTURE OF THE INVENTION

Figure 1:
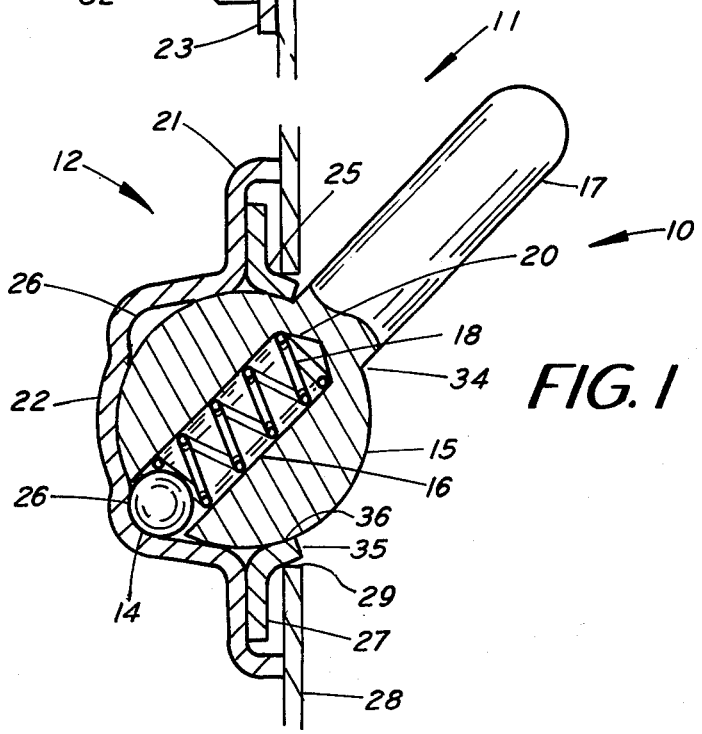
FIG. 1 is a section of the present invention taken along plane 1—1 of FIG. 2.

With continued reference to the drawings, and more particularly now to FIG. 1, it may be seen that the present invention, generally termed a relievable hanger and generally indicated at 10, comprises a ball-and-rod element, generally indicated at 11, a socket for the ball portion of the element 11 which is generally indicated at 12 and having at least one detent 26 therein, and a spring-biased locking member 14 for engagement with the detent 26.

With continued reference to FIG. 1, the ball-and-rod element 11, further comprises a ball 15 with a bore 16 therein and a rod 17. A compression spring 18 is nested within the bore 16. A locking member 14, here depicted as a ball, is positioned inside the bore 16 with the spring 18 compressionally arranged between the locking member 14 and the ball 15.

Figure 2:
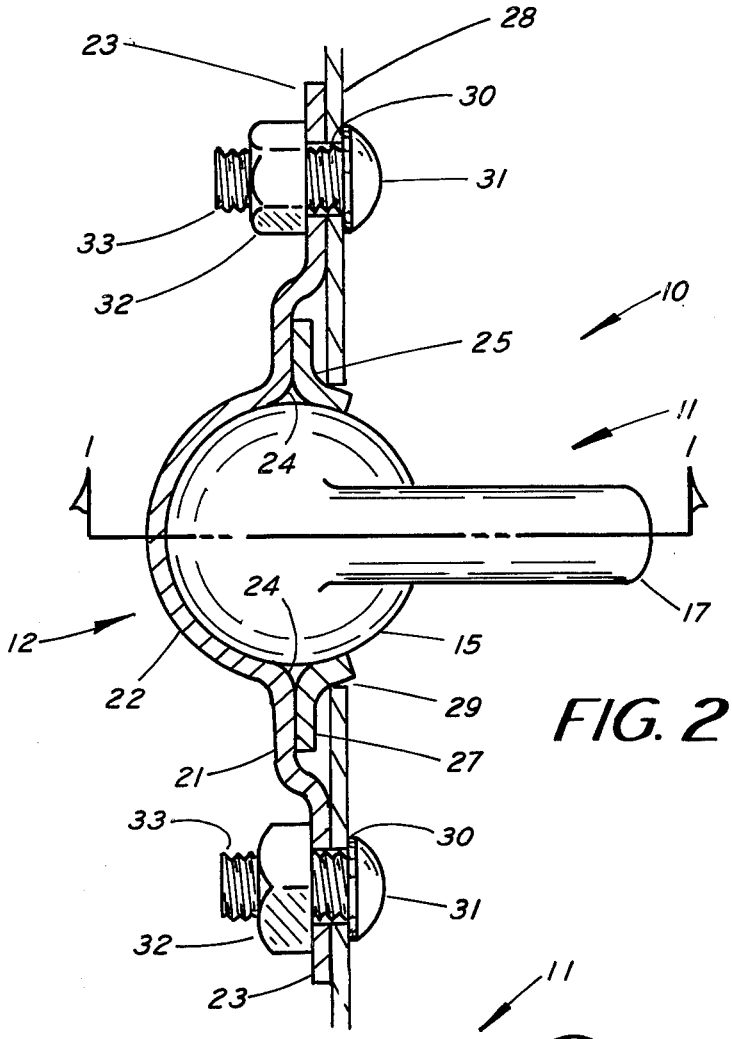
FIG. 2 is a plan view, partially in section, of the present invention.

With reference now to both FIGS. 1 and 2, it may be seen that a socket 12 is formed by the combining of a sheet metal structure 21 having a hemispherical depression 22 therein and a pair of oppositely-disposed, apertured arms 23 extending outwardly from the rim 24 of the hemispherical depression 22 and a ball retaining ring 25 which is also typically formed from sheet metal. Along the inside of the hemispherical depression 22 are one or more detents 26, the purpose of which will become clear as the description progresses hereinafterwards.

The present invention is assembled by passing the ball retaining ring 25 over the rod 17 and thereafterwards engaging it with the ball 15. The function of the ball retaining ring 25 is to prevent the ball 15 from leaving the hemispherically shaped depression 22 of structure 21. The spring 18 is placed within the bore 16 of the ball 15 and engages the bottom 20 thereof. After the spring 18 is positioned within the bore 16, the ball 19 is placed over the end of the spring 18 facing outwardly towards the outside of the ball 15. The hemispherically-shaped depression 22 of the structure 21 is then positioned about the ball 15 and into abutting engagement with the flange 27 about the retaining ring 25.

Typically, the relievable hanger 10 is mounted in a vertically-disposed wall, such as indicated at 28, through an aperture 29 therein. Generally, the wall 28 is formed of stainless steel sheet metal which is typically part of a lavatory cabinet serving to house a wash basin or sink and to which a toilet bowl is secured.

To mount the relievable hanger 10 to the wall 28, the rod 17 of the ball-and-rod element 11, is passed through the aperture 29 in the wall 28. The pair of apertured arms 23 of the structure 21 are then oriented so that the apertured portions of the arms 23 are aligned with a pair of oppositely-disposed apertures 30 in the wall 28 and located on either side of the aperture 29 through which the rod 17 is passed.

Typically, the relievable hanger 10 is mounted in a vertically-disposed wall, such as indicated at 28, through an aperture 29 therein. Generally, the wall 28 is formed of stainless steel sheet metal which is typically part of a lavatory cabinet serving to house a wash basin or sink and to which a toilet bowl is secured.

To mount the relievable hanger 10 to the wall 28, the rod 17 of the ball-and-rod element 11, is passed through the aperture 29 in the wall 28. The pair of apertured arms 23 of the structure 21 are then oriented so that the apertured portions of the arms 23 are aligned with a pair of oppositely-disposed apertures 30 in the wall 28 and located on either side of the aperture 29 through which the rod 17 is passed.

A pair of headed security-type bolts 31 which do not have a screwdriver receiving, slotted portion therein or a wrench-gripping surface thereabout are passed through the apertures 30 of the wall 38 and the apertures of the arms 23. Self-locking nuts 32 are threadably engaged with the threaded shank 33 of the bolts 31 and are rotated about the threaded shank 33 until the nut 32 and the headed portion of the bolts 31 are securely abutted to the wall 28. It should be noted at this time that the nuts 32 and the threaded shanks 33 of the bolts 31 are located in an area which is inaccessible from the area wherein the rod 17 lies. Obviously, it would not be a security-type fastening arrangement if this were not so.

OPERATION OF THE INVENTION

Referring now to FIG. 1, the relievable hanger 10 is depicted with the rod 17 in its upright position. When the rod 17 is in its upright position, the rod 17 will serve as a hanger or hook whereupon clothing or towels, or the like may be hung. As can be seen, when the ball-and-rod element 11 is oriented in this position, the compression spring 18 urges the locking member 14 (here, it is shown as a ball) into a detent 26 so that a portion of the locking member 14 resides within the detent 26 and a portion resides within the bore 16.

When a relatively large weight, say in the order of 25 pounds or more, is impressed upon the rod 17, the rod 17 is urged downwardly. The locking member 14 is, on the other hand, urged upwardly. As the locking member 14, travels upwardly, it is forced out of the detent 26 and is directed further into the bore 16 of the ball 15 as it begins to ride on the non-detented portion of the hemispherically-shaped depression 22 of the socket 12. As a result, the locking member 14 is forced against the spring 18 thereby compressing it further.

Once the locking member 14 leaves the detent 26, the rod 17 travels rapidly downward thereby allowing the weight, typically in the form of a member in tension, such as a rope or the like, to fall from the rod 17.

The rod 17 continues in its downward travel until the base portion of the rod 17 indicated at 34, engages the edge 35 of the rim 36 of the retaining ring 25.

In order to reset the relievable hanger 10, the rod 17 is manually lifted upwardly, thereby moving the locking member 14 downwardly until the locking member 14 is urged again into the detent 26, thereby relievably locking the hanger 10 in its towel hanging position.

It should be noted that two detents 26 are illustrated in FIG. 1. The second detent 26 serves exactly the same function as the other detent 26. Here, the second detent 26 is merely provided for convenience purposes only, so that the socket 12 may be functionally installed in either of its two possible installation positions.

Although the invention has been hereinbefore described and illustrated as embodied in a particular structure, other embodiments thereof will become readily apparent to those skilled in the art without departing from the spirit or scope of the invention, whose spirit and scope shall be established by the following claims.

We claim:

1. A ball joint relievable hanger for mounting on a wall whereupon towels and the like may be hung, comprising:

a. a body having a hemispherically-shaped depression therein, said depression having a pair of spaced detents therein;

b. a hanger element comprising a ball-shaped member with a rod fixedly attached thereto and extending therefrom, said ball-shaped member being disposed in said depression in contiguous relationship to the wall forming said depression within said body and freely movable therein, said ball-shaped member further having a passageway with a single opening thereinto facing the wall forming said depression in said body;

c. compression biasing means disposed within said passageway in said ball-shaped member of said hanger element;

d. retaining means for capturing said ball-shaped member within said depression;

e. a locking element disposed within said passageway in said ball-shaped member of said hanger and freely movable therein, one end of said locking element being disposed between said biasing means and said opening facing said depression and formed to be receivable into said detent, whereby said rod is locked into an upward position to form a hanger for towels and the like when said biasing means urges said one end of said locking element into said detent following alignment therewith and when a substantial weight is impressed upon said rod in said locked position, said locking element in said passageway within said ball-shaped member is urged into said passageway towards said biasing means and out of said detent thereby unlocking said ball-shaped member from its previously fixed position and allowing said rod to fall downwardly and permitting said substantial weight to fall freely therefrom; and f. said detents lying along a vertical plane passing through the center of said ball-shaped member, and being equally spaced above and below said center, whereby said hanger may be installed in either of two possible installation positions.

2. The hanger of claim 1, further comprising anchoring means for securing said body to said wall about an aperture in said wall, said rod being passed through said aperture and projecting outwardly away from said wall.

3. The hanger of claim 1, wherein said compression biasing means comprises a helically-wound, wire spring.

4. The hanger of claim 1, wherein said retaining means comprises:

a. an annular disc the inside rim of which has a lip projecting outwardly therefrom towards said rod and disposed in conformal engagement with at least a portion of said ball-shaped member of said hanger element and which extends beyond said wall of said body forming said depression; and b. means for securing said disc in relatively fixed relationship to said body.

5. The hanger of claim 1, wherein said locking element is a ball.

* * * * *